United States Patent [19]

Kaiserman et al.

[11] Patent Number: 5,071,586

[45] Date of Patent: Dec. 10, 1991

[54] PROTEASE-CONTAINING COMPOSITIONS STABILIZED BY PROPIONIC ACID OR SALT THEREOF

[75] Inventors: Howard B. Kaiserman, Cliffside Park; Patricia Siuta-Mangano, Woodcliff Lake, both of N.J.

[73] Assignee: Lever Brothers Company, Division of Conopco, Inc., New York, N.Y.

[21] Appl. No.: 664,513

[22] Filed: Mar. 5, 1991

Related U.S. Application Data

[63] Continuation-in-part of Ser. No. 559,222, Jul. 27, 1990.

[51] Int. Cl.[5] ..... C11D 3/386; C11D 3/37

[52] U.S. Cl. ..... 252/174.12; 252/156; 252/174.23; 252/173; 252/DIG. 2; 252/DIG. 12

[58] Field of Search ..... 252/174.12, DIG. 12, 252/156, 174.23, 173, DIG. 2

[56] References Cited

U.S. PATENT DOCUMENTS

| | | | |
|---|---|---|---|
| 4,243,546 | 1/1981 | Shaer | 252/174.12 |
| 4,261,868 | 4/1981 | Hora et al. | 252/529 |
| 4,287,082 | 9/1981 | Tolfo et al. | 252/174.12 |
| 4,305,837 | 12/1981 | Kaminsky et al. | 252/174.12 |
| 4,318,818 | 3/1982 | Letton et al. | 252/174.12 |
| 4,404,115 | 9/1983 | Tai et al. | 252/135 |
| 4,507,219 | 3/1985 | Hughes | 252/118 |
| 4,515,705 | 5/1985 | Moeddel | 252/174.12 |
| 4,537,707 | 8/1985 | Severson, Jr. | 252/545 |
| 4,652,394 | 3/1987 | Inamorato et al. | 252/174.12 |
| 4,820,437 | 4/1989 | Skabone et al. | 252/102 |

FOREIGN PATENT DOCUMENTS 1354761 5/1974 United Kingdom .

*Primary Examiner*—Paul Lieberman
*Assistant Examiner*—Erin Higgins
*Attorney, Agent, or Firm*—Ronald A. Koatz

[57] ABSTRACT

The present invention is concerned with the stabilization of proteases in built, anionic rich, aqueous detergent compositions. More particularly, applicants have discovered that propionic acid or a propionic salt capable of forming propionic acid unexpectedly increases stability relative to other stabilizers, e.g., formic acid or acetic acid (or salts thereof), used in these compositions.

5 Claims, No Drawings

PROTEASE-CONTAINING COMPOSITIONS STABILIZED BY PROPIONIC ACID OR SALT THEREOF

CROSS REFERENCES

This is a Continuation-in-Part of Ser. No. 559,222 filed July 27, 1990.

BACKGROUND OF THE INVENTION

1.Field of the Invention

This invention relates to the stabilization of proteases in built, anionic rich aqueous detergent compositions.

2. Prior Art

The use of proteases in heavy duty liquid detergent formulations (HDLs) is complicated by their limited stability in solution. Two processes which limit the shelf life of a protease in a liquid are denaturation and autolysis (self-digestion). Denaturation of proteases may be minimized by selection of formulation components (i.e., actives, builders, pH etc.) so that acceptable enzyme stability can be achieved. Self digestion of proteases may be minimized by inclusion of a protease inhibitor. The inhibitor is released from the enzyme upon dilution in the wash.

Various protease inhibitors are known in the art. Hora et al. U.S. Pat. No. 4,261,868 teaches the use of borax as a protease inhibitor and both Shaer U.S. Pat. No. 4,243,546 and British Patent No. 1,354,761 (Henkel) teach the use of carboxylic acids as protease inhibitors. Various combinations of these protease inhibitors are also known in the art. Kaminsky et al. U.S. Pat. No. 4,305,837, for example, teaches the combination of carboxylic acids and simple alcohols and Tai U.S. Pat. No. 4,404,115 teaches the combination of borax and polyols as protease inhibitors. Severson U.S. Pat. No. 4,537,707 teaches the combination of borax and carboxylates as protease inhibitors.

As mentioned above, the use of carboxylates in detergent compositions as protease inhibitors is known. Letton et al U.S. Pat. No. 4,318,818, for example, teaches stabilized, liquid enzyme compositions in which the inhibitor is a short chain length carboxylic acid salt selected from the group consisting of formates, acetates, propionates and mixtures thereof. This patent teaches that formates are surprisingly much more effective than other short chain salts such as acetates and propionates. The reference also teaches that at a pH range above 8.5, only formates can be used. The detergent compositions used in this patent are unbuilt, i.e., contain no builders.

Shaer U.S. Pat. No. 4,243,546 teaches aqueous enzyme compositions wherein the enzyme stabilizer is selected from the group consisting of mono and diacids having from 1 to 18 carbon atoms. Acetic acid is said to be preferred. Compositions of the invention are also unbuilt. The patent seems to be primarily directed to compositions having a pH below 8 (most of the examples have a pH of 7.5) and the one example which has a pH of 9.5 appears to require the presence of alcohol (ethanol). In addition, the compositions of Shaer not only are not anionic rich, but appear to comprise no anionics at all.

British Patent 1,354,761 (Henkel) teaches compositions which may contain 2 to 8 carbon carboxylic acids. All the examples show use of acetic acid and the detergent compositions of the invention are also unbuilt.

Thus, where carboxylic acid stabilizers are used in the prior art, there is a preference for 1 or 2 carbon carboxylic acids (acetate and formate). When compositions of high pH (i.e. greater than 8.5) are used in the prior art, either the use of formate is dictated (as in Letton et al. U.S. Pat. No. 4,318,818) or the carboxylic acid is used in combination with an alcohol or in an environment which is not anionic rich. The compositions of the prior art are also unbuilt and there appears to be n recognition of the importance of using anionic rich compositions with specific stabilizers.

Unexpectedly, applicants have discovered that, when the detergent composition is a built, anionic rich composition having a pH greater than 8.5, more preferably 9.0 and above, enzyme stability is enhanced relative to other carboxylic acid stabilizers (i.e. acetate or formate) by the use of propionate rather than acetate or formate.

SUMMARY OF THE INVENTION

The subject invention provides a stable, aqueous enzyme composition comprising:

(1) from about 5% to about 65% by weight of anionic surfactant or anionic surfactant and one or more detergent actives wherein the ratio of anionic to non-anionic by weight is greater than 1:1;

(2) from about 0.5% to about 50% by weight of a builder;

(3) a protease enzyme added in sufficient quantity to have an activity level of 0.01 to 100,000 GU/gm;

(4) from about 0.1% to about 15% by weight propionic acid or a propionic acid salt capable of forming propionic acid;

(5) from about 0.01% to about 1% of calcium salt providing free calcium ions to the composition; and (6) remainder water and minor ingredients;

wherein the pH of the composition is greater than 8.5.

The pH of the composition is greater than 8.5, preferably 9.0 and above.

According to the present invention, propionic acid or salts thereof in compositions having a pH range above 8.5, preferably above 9.0, unexpectedly provide superior enzyme stability relative to formic acid and acetic acid (and their respective salts) stabilizers.

DETAILED DESCRIPTION OF THE INVENTION

Detergent Active

The compositions of the invention comprise from about 5% to about 65% by weight of (a) anionic surfactant or (b) anionic surfactant and one or more detergent actives wherein the ratio of anionic to non-anionic by weight is greater than 1:1.

The detergent active material other than anionic surfactant may be an alkali metal or alkanolamine soap or a 10 to 24 carbon atom fatty acid, including polymerized fatty acids, or a nonionic, cationic, zwitterionic or amphoteric synthetic detergent material, or mixtures of any of these.

Examples of the anionic synthetic detergents are salts (including sodium, potassium, ammonium and substituted ammonium salts such as mono-, di- and triethanolamine salts of 9 to 20 carbon alkylbenzenesulphonates, 8 to 22 carbon primary or secondary alkanesulphonates, 8 to 24 carbon olefinsulphonates, sulphonated polycarboxylic acids prepared by sulphonation of the pyrolyzed product of alkaline earth metal citrates, e.g., as described in British Patent Specification No. 1,082,179, 8 to 22 carbon alkylsulphates, 8 to 24 carbon alkylpolyglycol-ether-sulphates, -carboxylates and -phosphates (containing up to 10 moles of ethylene oxide); further examples are described in "Surface Active Agents and Detergents" (Vol. I and II) by Schwartz, Perry and Berch. Any suitable anionic may be used and the examples are not intended to be limiting in any way.

Examples of nonionic synthetic detergents which may be used with the invention are the condensation products of ethylene oxide, propylene oxide and/or butylene oxide with 8 to 18 carbon alkylphenols, 8 to 18 carbon primary or secondary aliphatic alcohols, 8 to 18 carbon fatty acid amides; further examples of nonionics include tertiary amine oxides with one 8 to 18 carbon alkyl chain and two 1 to 3 carbon alkyl chains. The above reference also describes further examples of nonionics.

The average number of moles of ethylene oxide and/or propylene oxide present in the above nonionics varies from 1-30; mixtures of various nonionics, including mixtures of nonionics with a lower and a higher degree of alkoxylation, may also be used.

Examples of cationic detergents are the quaternary ammonium compounds such as alkyldimethylammonium halogenides.

Examples of amphoteric or zwitterionic detergents which may be used with the invention are N-alkylamino acids, sulphobetaines, condensation products of fatty acids with protein hydrolysates; but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with a anionic and/or nonionic synthetic detergent.

Builders

Builders which can be used according to this invention include conventional alkaline detergency builders, inorganic or organic, which can be used at levels from about 0.5% to about 50% by weight of the composition, preferably from 3% to about 35% by weight. More particularly, when non-structured compositions are used, preferred amounts of builder are 3 to 10% and when structured compositions are used, preferred amounts of builder are 5%-35% by weight.

By structured liquid composition is meant a composition in which at least some of the detergent active forms a structured phase which is capable of suspending a solid particulate material.

More particularly, when a structured liquid is contemplated, the composition requires sufficient electrolyte to cause the formation of a lamellar phase by the soap/surfactant to endow solid suspending capability. The selection of the particular type(s) and amount of electrolyte to bring this into being for a given choice of soap/surfactant is effected using methodology very well known to those skilled in the art. It utilizes the particular techniques described in a wide variety of references. One such technique entails conductivity measurements. The detection of the presence of such a lamellar phase is also very well known and may be effected by, for example, optical and electron microscopy or x-ray diffraction, supported by conductivity measurement.

As used herein, the term electrolyte means any water-soluble salt. The amount of electrolyte should be sufficient to cause formation of a lamellar phase by the soap/surfactant to endow solid suspending capability. Preferably the composition comprises at least 1.0% by weight, more preferably at least 5.0% by weight, most preferably at least 17.0% by weight of electrolyte. The electrolyte may also be a detergency builder, such as the inorganic builder sodium tripolyphosphate, or it may be a non-functional electrolyte such as sodium sulphate or chloride. Preferably the inorganic builder comprises all or part of the electrolyte.

Such structured compositions ar capable of suspending particulate solids, although particularly preferred are those systems where such solids are actually in suspension. The solids may be undissolved electrolyte, the same as or different from the electrolyte in solution, the latter being saturated in electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used (in structured or unstructured compositions) are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g.,sodium and potassium ethylenediaminetetraacetates, nitrilotriacetates and N-(2 hydroxyethyl)-nitrilodiacetates; (2)water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,1,2,3-tetraphosphonic acid; (4) water-soluble salts of polycarboxylate polymers and copolymers as described in U.S. Pat. No 3,308,067.

In addition, polycarboxylate builders can be used satisfactorily, including water-soluble salts of mellitic acid, citric acid, and carboxymethyloxysuccinic acid and salts of polymers of itaconic acid and maleic acid. Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a $Mg++$ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$hardness per gram; and a calcium exchange rate on an anhydrous basis of at least about 2 grains/gallon/minute/gram. These synthetic aluminosilicates are more fully described in British Pat. No. 1,429,143.

The Enzymes

The proteolytic enzyme used in the present invention can be of vegetable, animal or microorganism origin. Preferably, it is of the latter origin, which includes yeasts, fungi, molds and bacteria. Particularly preferred are bacterial subtilisin type proteases, obtained from e.g. particular strains of B. subtilis and B. licheniformis. Examples of suitable commercially available proteases are Alcalase, Savinase, Esperase, all of NOVO Industri a/s; Maxatase and Maxacal of Gist-Brocades; Kazusase of Showa Denko; BPN' and BPN'-derived proteases and so on. The amount of proteolytic enzyme included in the composition ranges from 0.01 to 100,000 GU/gm, based on the final composition. Naturally, mixtures of different proteolytic enzymes may be used.

A GU is a glycine unit, which is the amount of proteolytic enzyme which under standard incubation conditions produces an amount of terminal $NH_2$ -groups equivalent to 1 microgramme/ml of glycine.

Stabilizer

As mentioned above, the stabilizer used according to the subject invention is a propionic acid added neat or propionic acid added as salt at a level of about 0.1 to about 15% of the composition.

Calcium Salt

The compositions of the invention also comprise a calcium salt which is used to provide free calcium ions to the solution. The calcium ions impart stabilization to the enzyme either alone or in combination with the propionate. Examples of calcium salts which may provide free calcium ions to the system include calcium chloride dihydrate and calcium sulfate. The calcium salt may comprise from 0.01 to 1% of the composition, preferably 0.01% to 0.2%, most preferably 0.03 to 0.1%.

Optional Components

In addition to the essential ingredients described hereinbefore, the preferred compositions herein frequently contain a series of optional ingredients which are used for the known functionality in conventional levels. While the inventive compositions are premised on aqueous enzyme-containing detergent compositions, it is frequently desirable to use a phase regulant. This component together with water constitutes then the solvent matrix for the claimed liquid compositions. Suitable phase regulants are well-known in liquid detergent technology and, for example, can be represented by hydrotropes such as salts of alkylarylsulfonates having up to 3 carbon atoms in the alkylgroup, e.g., sodium, potassium, ammonium and ethanolamine salts of xylene-, toluene-, ethylbenzene-, cumene-, and isopropylbenzene sulfonic acids. Alcohols may also be used as phase regulants. This phase regulant is frequently used in an amount from about 0.5% to about 20%, the sum of phase regulant and water is normally in the range from 35% to 65%.

The preferred compositions herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

The beneficial utilization of the claimed compositions under various usage conditions can require the utilization of a suds regulant. While generally all detergent suds regulants can be utilized, preferred for use herein are alkylated polysiloxanes such as dimethylpolysiloxane also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The compositions herein can also contain known antioxidants for their known utility, frequently radical scavengers in the art established levels, i.e. 0.001% to 0.25% (by reference to total composition). These antioxidants are frequently introduced in conjunction with fatty acids.

The compositions of the invention may also contain other enzymes in addition to the proteases of the invention such as lipases, amylases and cellulases. When present, the enzymes may be used in an amount from 0.1% to 5% of the compositions.

Another optional ingredient which may be used particularly in structured liquids, is a deflocculating polymer.

In general, a deflocculating polymer comprises a hydrophobic backbone and one or more hydrophobic side chains and allows, if desired, the incorporation of greater amounts of surfactants and/or electrolytes than would otherwise be compatible with the need for a stable, low-viscosity product as well as the incorporation, if desired, of greater amounts of other ingredients to which lamellar dispersions are highly stability-sensitive.

The hydrophilic backbone generally is a linear, branched or highly crosslinked molecular composition containing one or more types of relatively hydrophobic monomer units where monomers preferably are sufficiently soluble to form at least a 1% by weight solution when dissolved in water. The only limitations to the structure of the hydrophilic backbone are that they be suitable for incorporation in an active-structured aqueous liquid composition and that a polymer corresponding to the hydrophilic backbone made from the backbone monomeric constituents is relatively water soluble (solubility in water at ambient temperature and at pH of 3.0 to 12.5 is preferably more than 1 g/1). The hydrophilic backbone is also preferably predominantly linear, e.g., the main chain of backbone constitutes at least 50% by weight, preferably more than 75%, most preferably more than 90% by weight.

The hydrophilic backbone is composed of monomer units selected from a variety of units available for polymer preparation and linked by any chemical links including —0—,

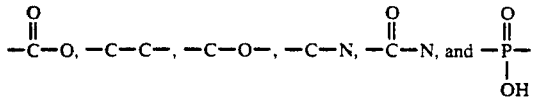

Preferably the hydrophobic side chains are part of a monomer unit which is incorporated in the monomer by copolymerizing hydrophobic monomers and the hydrophilic monomer making set the backbone. The hydrophobic side chains preferably include those which when isolated from their linkage are relatively water insoluble, i.e., preferably less than 1 g/l, more preferred less than 0.5 g/l, most preferred less than 0.1g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups.

Monomer units which made up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinylalcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic sidechain may be substituted with groups such as amino, amine, amide, sulphonate, sulphate, phosphonate, phosphate, hydroxy, carboxyl and oxide groups.

The hydrophilic backbone is preferably composed of one or two monomer units but may contain three or more different types. The backbone may also contain small amounts of relatively hydrophilic units such as those derived form polymers having a solubility of less than 1 g/l in water provided the overall solubility of the polymer meets the requirements discussed above. Examples include polyvinyl acetate or polymethyl methacrylate.

The deflocculating polymer generally will comprise, when used, from about 0.1 to about 5% of the composition, preferably 0.1 to about 2% and most preferably, about 0.5 to about 1.5%.

Product pH pH of the compositions of the invention is from above 8.5 to 11.5, preferably from above 8.5 to 11, and most preferably from 9 to 10.5.

The following examples are intended to illustrate the invention and facilitate its understanding and are not meant to limit the invention in any way.

Compositions of the Invention

The compositions of the invention are as follows:

| Composition A (Isotropic Non-Structured Composition) | |
|---|---|
| Ingredients | Weight % |
| Sodium linear alkyl benzene sulfonate | 10.0 |
| Neodol 25-9 | 8.0 |
| Neodol 25-3S | 6.0 |
| Sodium xylene sulfonate | 3.0 |
| Builder | 7.0 |
| Triethanolamine | 2.0 |
| Monoethanolamine | 2.0 |
| Fatty acid | 0.8 |
| Protease (Savinase) | 0.38 |
| NaOH | to pH 10 |
| Carboxylic acid stabilizer (Na salt) | .31 molar* |
| Calcium chloride dihydrate | .035 |
| Water | to 100% |

*.31 molar corresponds to 2.1% by weight for formate, 2.6% by weight for acetate and 3.0% by weight for propionate.

| Composition B (Structured, Built Composition) | |
|---|---|
| Ingredients | Weight % |
| Linear alkyl benzene sulfonate | 6.72 |
| Nonionic (primary alcohol alkylene oxide condensate) | 4.8 |
| Sodium xylene sulfonate | 0.8 |
| Builder | 23.85 |
| Alkali metal salts | 2.44 |
| Protease | 0.38 |
| Minors plus water | to 100% |
| Carboxylic acid stabilizer | .31 Molar* |
| Calcium chloride dihydrate | 0.1 |
| pH | 8.4 |

*corresponding to 2.1% by weight formate, 2.5% by weight acetate, or 3.0% by weight propionate

| Composition C (Structured, Built Composition) | |
|---|---|
| Ingredients | Weight % |
| Linear Alkyl Benzene Sulfonate | 16.5 |
| Nonionic (Primary Alcohol Alkylene Oxide Condensate) | 9.0 |
| Builder | 23.23 |
| Fatty Acid | 4.5 |
| Alkali Metal Salts | 10.5 |
| Protease | 0.38 |
| Minors plus water | to 100% |
| Carboxylic acid stabilizer | .31 Molar* |
| Calcium chloride dihydrate | 0.1 |
| pH | 9.1 |

*Corresponding to 2.1% by weight formate, 2.6% by weight acetate, or 3.0% by weight propionate

EXAMPLE 1

When equal mole percentages of the formate salt, acetate salt and propionate salt (i.e., 0.31 molar) were added and compared in Composition A above, stability results were as follows:

| Carboxylate Salt Added | Stability $t_{\frac{1}{2}}$ (days) |
|---|---|
| none | 5 |
| formate | 20 |
| acetate | 23 |
| propionate | 31 |

The stability of the protease was determined by measuring protease activity (spectophotometric techniques using tetrapeptide substrate) as a function of storage time at 37 degrees centigrade. Half-lives were determined by plotting Ao/At versus time and performing non-linear regression analysis.

These results establish that the half-life stability for Savinase in built anionic-rich detergent compositions having a pH higher than 8.5, preferably higher than 9.0, was superior when propionate was used compared to where either formate or acetate were used. The result was unexpected in view of the superior stability data for formate and acetate stabilizers relative to propionate in the art. It is clear that in the specifically defined compositions of the invention (anionic-rich, built compositions having defined pH ranges), different results are found.

EXAMPLE 2

Equal mole percentages of formate salt, acetate salt and propionate salt (i.e., 0.31 molar) were added and tested in structured composition B and C above and the following results were observed:

| Composition B | | | |
|---|---|---|---|
| Carboxylate Salt Added | Protease | % Protease Activity Left After 215 hrs. | % Improvement |
| none | Savinase | 43.74 | — |
| formate | Savinase | 66.42 | 52 |
| acetate | Savinase | 69.15 | 58 |
| propionate | Savinase | 80.69 | 85 |
| none | BPN' | 17.23 | — |
| formate | BPN' | 27.28 | 58 |
| acetate | BPN' | 28.03 | 63 |
| propionate | BPN' | 43.89 | 155 |

| Composition C | | | |
|---|---|---|---|
| Carboxylate Salt Added | Protease | % Protease Activity Left After 215 hrs. | % Improvement |
| none | BPN' | 38.27 | — |
| formate | BPN' | 48.53 | 27 |
| acetate | BPN' | 47.59 | 24 |
| propionate | BPN' | 59.42 | 55 |

These results show that propionate provides significant improvement in protease stability over time in structured, anionic rich compositions of defined pH. These results are unexpected in view of the teachings of the prior art.

EXAMPLE 3

Equal mole percentages of formate salt, acetate salt and propionate salt were tested in a composition essentially the same as structured Composition B except that the pH range was varied. The following results were observed:

| Composition B at pH 8.0 | | | |
|---|---|---|---|
| Carboxylate Salt Added | Protease | % Protease Activity Left After About 195 hrs. | % Improvement |
| none | BPN' | 23.31 | — |
| formate | BPN' | 36.29 | 55 |
| acetate | BPN' | 36.29 | 55 |
| propionate | BPN' | 50.90 | 118 |

| Composition B at pH 8.6 | | | |
|---|---|---|---|
| Carboxylate Salt Added | Protease | % Protease Activity Left After About 195 hrs. | % Improvement |
| none | BPN' | 21.17 | — |
| formate | BPN' | 29.93 | 41 |
| acetate | BPN' | 31.21 | 47 |
| propionate | BPN' | 40.98 | 94 |

| Composition B at pH 9.0 | | | |
|---|---|---|---|
| Carboxylate Salt Added | Protease | % Protease Activity Left After About 195 hrs. | % Improvement |
| none | BPN' | 16.89 | — |
| formate | BPN' | 27.18 | 61 |
| acetate | BPN' | 27.66 | 64 |
| propionate | BPN' | 38.04 | 125 |

As can be clearly seen from the above results, an unexpected increase in stability, using propionate stabilizer relative to formate or acetate stabilizer, was observed across various pH ranges.

EXAMPLE 4

Use of propionate in structured liquids

The following two structured, duotropic compositions were prepared (all percentages by weight):

| | 1 | 2 |
|---|---|---|
| Sodium linear alkyl benzene sulfonate | 23 | 23 |
| Nonionic | 10 | 10 |
| Sodium citrate | 16.5 | 11.5 |
| Triethanolamine | — | — |
| Na-carbonate | — | — |
| Na-propionate | — | 5 |
| Protease | 0.38 | 0.38 |
| Deflocculating polymer* | 1 | 1 |
| Water & minors | . . . to 100% . . . | |
| pH | 8.5 | 8.5 |
| Half life at 37° C. (days) for Savinase | 2.1 | 4.5 |

It should be noted that for this example, as well as all the other examples in the specification, free calcium ions are supplied to the compositions from the enzyme concentrate.

As can be observed half life was significantly increased (i.e. greater than 100%) with the addition of propionate.

EXAMPLE 5

Use of propionate in structured liquids including comparison of stability with propionate versus acetate The following structured duotropic liquid compositions were prepared (all percentages by weight):

| | 1 | 2 | 3 |
|---|---|---|---|
| Sodium linear alkyl benzene sulfonate | 28 | 28 | 28 |
| Nonionic | 12 | 12 | 12 |
| Na-Citrate | 10 | 10 | 10 |
| Triethanolamine | 4 | 4 | 4 |
| Na-propionate | — | 5 | — |
| Na-acetate | — | — | 7.7 |
| Protease | 0.38 | 0.38 | 0.38 |
| Deflocculating polymer* | 1 | 1 | 1 |
| Water & minors | | to 100% | |

-continued

| | 1 | 2 | 3 |
|---|---|---|---|
| pH | 9.3 | 9.3 | 9.3 |
| ½ life at 37° C. (days) for Savinase | 0.3 | 1.6 | 0.6 |

*The liquid preparations were prepared according to the technique disclosed in EP 0,346,995, and the polymer corresponded to the polymers used in the examples of that composition.

As can be observed half life of enzyme in compositions containing propionate was superior to those containing acetate.

EXAMPLE 6

Use of propionate in structured liquids

The following structured, duotropic compositions were prepared (all percentages by weight):

| | 1 | 2 |
|---|---|---|
| Sodium linear alkyl benzene sulfonate | 28 | 28 |
| Nonionic | 12 | 12 |
| Na-Citrate | 8 | 8 |
| Na-carbonate | 4 | 4 |
| Na-propionate | — | 5 |
| Protease | 0.38 | 0.38 |
| Deflocculating polymer* | 1 | 1 |
| Water & minors | to 100% | |
| pH | 9.2 | 9.2 |
| ½ life at 37° C. (days) for Savinase | 0.5 | 0.8 |

*The liquid preparations were prepared according to the technique disclosed in EP 0,346,995, and the polymer corresponded to the polymers used in the examples of that composition.

As can be observed, addition of propionate increased stability of Savinase in the structured compositions.

We claim:

1. A stable aqueous enzyme composition comprising:

(a) from about 5 to about 65% by weight (i) anionic surfactant or (ii) anionic surfactant and one or more detergent actives; wherein the ratio of anionic to non-anionic by weight is greater than 1:1;

(b) from about 0.5 to about 50% by weight builder;

(c) a protease enzyme added in sufficient quantity to have an activity level of 0.01 to 100,000 GU/gm;

(d) from about 0.1 to about 15% by weight propionic acid or a propionic acid salt capable of forming propionic acid;

(e) from about 0.01 to about 1% of a calcium salt; and (f) remaining water and minor ingredients;

wherein the pH of the composition is equal to or greater than 8.6.

2. A composition according to claim 1 wherein (a) (ii) comprises a mixture of anionic and nonionic surfactants.

3. A composition according to claim 1, wherein if the composition is structured, 5 to 35% by weight builder is used.

4. A composition according to claim 1 wherein, if the composition is not structured, 3 to 10% builder is used.

5. A stable aqueous enzyme composition comprising:

(a) from about 5 to about 65% by weight (i) anionic surfactant or (ii) anionic surfactant and one or more detergent actives; wherein the ratio of anionic to non-anionic by weight is greater than 1:1;

(b) from about 0.5 to about 50% by weight builder;

(c) a protease enzyme added in sufficient quantity to have an activity level of 0.01 to 100,000 GU/gm;

(d) from about 0.1 to about 15% by weight propionic acid or a propionic acid salt capable of forming propionic acid;

(e) from about 0.01 to about 1% of a calcium salt; and (f) from about 0.1 to about 5% of a deflocculating polymer and;

(g) remaining water and minors;

wherein the pH of the composition is equal to or greater than 8.6.

* * * * *